United States Patent [19]

Bolton et al.

[11] Patent Number: 4,621,570

[45] Date of Patent: Nov. 11, 1986

[54] LOUVER ASSEMBLY

[75] Inventors: Theodore S. Bolton, Liverpool; Robert J. Whitwell, Nedrow, both of N.Y.

[73] Assignee: Carrier Corporation, Syracuse, N.Y.

[21] Appl. No.: 770,950

[22] Filed: Aug. 30, 1985

[51] Int. Cl.[4] ..... F24F 13/00

[52] U.S. Cl. ..... 98/114; 98/40.24; 98/121.2; 29/157.1 R

[58] Field of Search ..... 98/121.2, 114, 40.24; 29/157.1 R

[56] References Cited

U.S. PATENT DOCUMENTS

| | | | |
|---|---|---|---|
| 2,359,289 | 10/1944 | Brown | 98/121.2 |
| 3,390,542 | 2/1968 | Perry et al. | 62/262 |
| 3,431,748 | 3/1969 | Bolton | 62/262 |
| 3,456,574 | 7/1969 | Jakeway | 98/121.2 |
| 3,680,470 | 8/1972 | Neece | 98/121.2 |
| 3,741,102 | 6/1973 | Kaiser | 98/121.2 |
| 4,492,094 | 1/1985 | Katayama | 62/262 |

*Primary Examiner*—Ronald C. Capossela
*Attorney, Agent, or Firm*—Dana F. Bigelow

[57] ABSTRACT

Apparatus and assembly for a louver structure to be mounted in an air discharge opening of a room air conditioner. The individual louvers are installed by sliding their end mounting pins into slots formed in their associated side support members. Retainer bars are then placed over the mounting pins and secured into position to maintain the louvers in place. The retainer bars may include slots that engage pivot pins on the respective louvers such that the retainer bars then act as gang bars to coordinate the pivotal movement of the louvers.

8 Claims, 5 Drawing Figures

LOUVER ASSEMBLY

BACKGROUND OF THE INVENTION

This invention relates generally to air conditioning systems and, more particularly, to a louver assembly for an air discharge opening of a room air conditioner.

Air conditioning of discreet spaces of residential and light commercial buildings is commonly provided by relatively small room air conditioning systems. These systems are normally mounted in an existing window opening or in an opening formed in a wall for that specific purpose, i.e., a so-called "through the wall" unit. The units include an outdoor section and an indoor section with the outdoor section including a compressor, a condenser coil, and a fan to circulate the outdoor air across the condenser coil. The indoor section includes an evaporator coil and a fan for circulating the indoor air across the evaporator coil. Openings are provided in the indoor section for receiving the warm air to be conditioned and for discharging the conditioned air to the room. While the air intake opening normally has a front cover with a stationary grille, the air discharge opening may have an adjustable louver assembly which can be selectively positioned to conduct the air flow in a desired direction. The louvers may be adjustable in either the vertical or the horizontal planes, or there may be a combination of the two to provide adjustable movement in both planes. Such an arrangement is especially desirable for a so-called "side discharge" unit.

A typical louver assembly includes a plurality of spaced louvers pivotally mounted in a pair of spaced side support elements. The louvers are generaly linked by way of a common gang bar to coordinate their pivotal positions within their support structure. Such a louver assembly is simple in design and operation but difficult to assemble. For example, a typical method of assembly of a louvered structure of the type described hereinabove, is to first insert the one end of each of the louvers into one of the side support elements and then to align the other ends thereof such that the opposite side support member may be installed to capture the other ends of the individual louvers. However, such a process requires precise fixturing to properly maintain the alignment of the louvers so as to easily allow the placement of the second side support member into position.

Another assembly approach is to assemble one louver at a time with both of its ends being inserted into their respective side retainer members before going on to the next louver. This procedure requires that the two side retainer members be placed at an angle with respect to each other and then be gradually brought together to reduce that angle as more louvers are added to the assembly. Again, the problem of fixturing is tedious and difficult to accomplish.

It is therefore an object of this invention to provide, in an air conditioning unit, an improved method of assembly for a louver structure.

Another object of this invention is the provision in an air conditioning system for a louver structure which does not require precise fixturing to accommodate its assembly.

Yet another object of the present invention is the provision for a louver structure which is easily and quickly assembled.

Still another object of the present invention is the provision in an air conditioning system for a louver assembly which is economical to manufacture and extremely functional in use.

These objects and other features and advantages become more readily apparent upon reference to the following description when taken in conjunction with the appended drawings.

SUMMARY OF THE INVENTION

Briefly, in accordance with one aspect of the invention, the side support members are fixed in their laterally spaced positions by way of a connecting framework. The side support members have a plurality of longitudinally spaced slots formed in their edges. The individual louvers are placed into position with their opposite mounting pins sliding into the aligned slots of the respective side support members. When all of the louvers have been so placed into position, a pair of retaining bars are placed over and attached to the respective side support elements so as to secure the louver mounting pins within the respective slots. Subsequent removal of any or all of the individual louvers, for purposes of replacement or the like, can then be accomplished by simply removing the two retainer bars sliding the louver mounting pins out of the slots, installing a new louver in the same manner as above, and replacing the retainer bars into their installed positions.

In accordance with another aspect of the invention, the individual louvers have formed thereon, at positions spaced inwardly (downstream) from the mounting pins, a pair of pivot pins extending transversely outward in opposite directions. In turn, the two retainer bars have corresponding slots formed therein such that when the retainer bars are placed in their installed positions, the individual pivot pins slide into the corresponding retainer bar slots. In this way, the retainer bar acts as a gang bar to coordinate the pivotal movement of the individual louvers.

By yet another aspect of the invention, the retainer bars are inverted U-shaped in cross section, and the two legs of each are placed on opposite sides of the associated side support member when in the installed position. One of the legs of each of the retainer bars has notches formed therein and are so located with respect to corresponding flanges on a surface of the side support members that when the retainer bars are installed, the flanges engage the notches to maintain the retainer bars in their installed positions.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
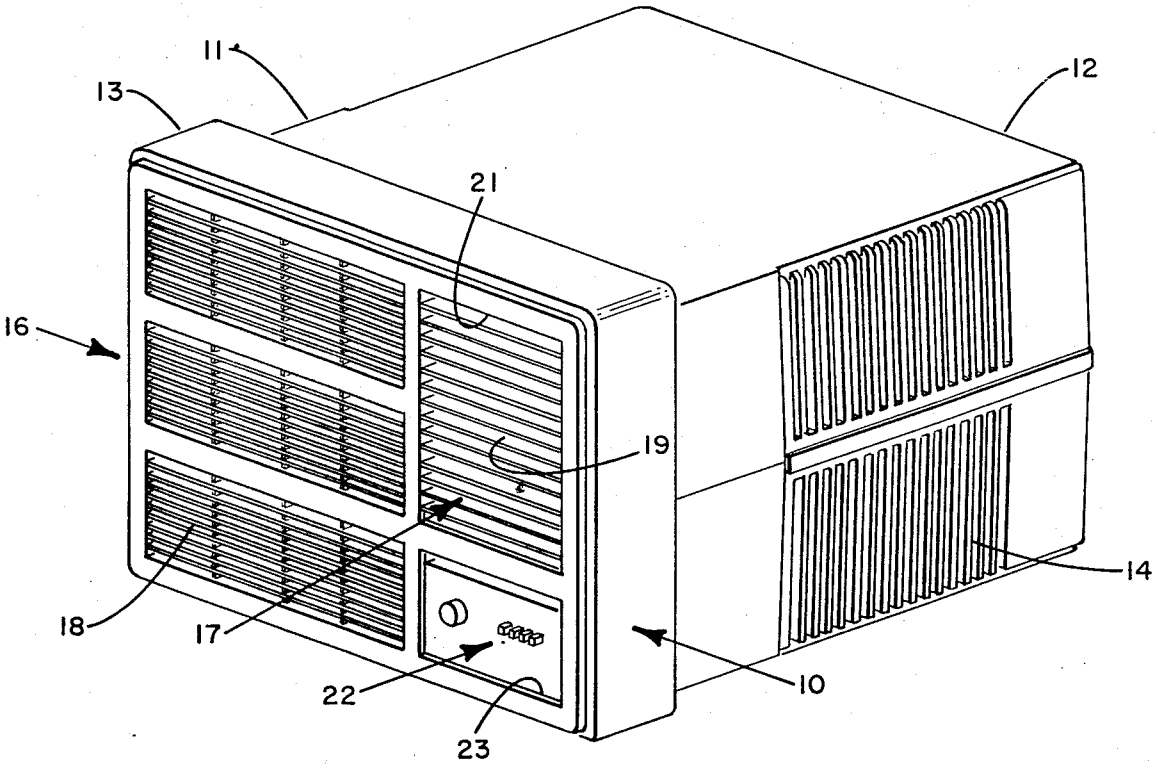
FIG. 1 is a perspective view of an air conditioning unit with a preferred embodiment of the invention incorporated therein.

Referring now to FIG. 1, the invention is shown generally at 10 as part of an otherwise conventional room air conditioner unit 11 which includes a cabinet 12 and a front cover structure 13. The cabinet 12 houses an indoor section, nearest the front cover 13, and an outdoor section at the outer portion thereof. When the unit is in its installed position within a wall opening, the outdoor portion thereof operates to draw outdoor air in through the air intake openings 14 and force air out by the condenser fan through the condenser coil and out the discharge openings at the rear (not shown).

On the indoor side, the warm room air is drawn in through the return air openings 16 to pass through the evaporator coil to be cooled and then discharged from the air discharge opening 17. The return air opening 16 is covered by fixed louvers 18 that are integrally attached to the front cover structure 13, while the air discharge opening 17 is covered by the louver structure 19 of the present invention, such louver structure being separate from, but surrounded by the rectangular framework 21 of the front cover structure 13. Similarly, the control panel 22 is a separate component which is installed in the indoor section and then surrounded by the rectangular opening 23 of the front grille structure 13.

It should be mentioned that the present invention is being described herein in terms of use with a "side discharge" unit as shown. However, it will be understood that it may, as well, be used with other configurations such as, for example, a top discharge unit.

Figure 2:
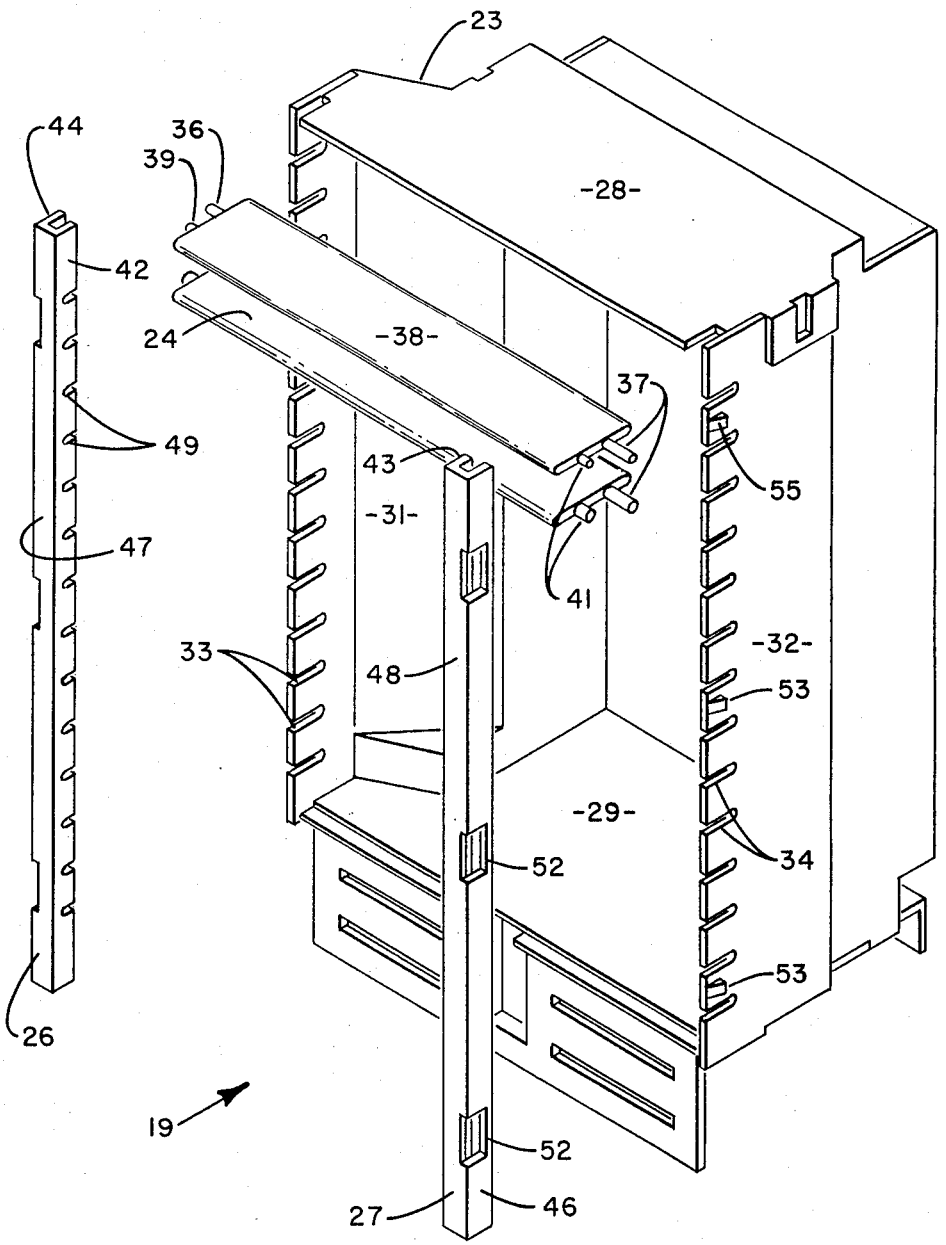
FIG. 2 is an exploded view of the air discharge and louver assembly portion of the air conditioning unit in accordance with the preferred embodiment of the invention.

Referring now to FIG. 2, the louvered structure 19 is shown in exploded form to include a housing 23, a plurality of longitudinally spaced louvers 24, and a pair of retainer bars 26 and 27. The housing 23 comprises upper and lower walls 28 and 29, and side support walls 31 and 32, all integrally attached to form the rectangular housing 23 to be placed in the air discharge opening 17 and attached to the body of the unit indoor section.

The side support walls 31 and 32 have formed at their inner edges, a plurality of longitudinally spaced, rearwardly extending slot 33 and 34, respectively, for receiving corresponding mounting pins 36 and 37, respectively, of the associated louvers 24. The blade portion 38 of the louvers 24 are thus pivotally suspended between the side support walls 31 and 32 by the mounting pins 36 and 37 which extend through, and are supported by the slots 33 and 34, respectively.

Also extending transversely at opposite ends of the louver blades 38 are pivot pins 39 and 41. The pivot pins 39 and 41 are sufficiently spaced from the mounting pins 36 and 37, respectively, that when the mounting pins 36 and 37 are fully installed in their respective slots, the associated pivot pins 39 and 41 are still not within the slots, thereby ensuring the ability of the louvers 24 to freely pivot on the mounting pins 36 and 37. The purpose of the pivot pins 39 and 41 is to provide for connection to a gang bar structure which operates to maintain the individual louvers 24 at the same pivoted angle on the axis of the mounting pins 36 and 37.

The retainer bars 26 and 27 are U-shaped structures having respective inner legs 42 and 43, outer legs 44 and 46, and interconnecting legs 47 and 48. The transverse length of the legs 47 and 48, and thus the distance between the associated inner and outer legs of the retainer members 26 and 27 are such that the inner and outer legs can straddle the associated side support walls 31 and 32 when the retainer bars 27 and 28 are placed in their installed positions. At such time, the outer legs 44 and 46 are in overlapping relationship with the respective side support walls 31 and 32 to the extent that the edges of the outer legs 44 and 46 come to rest against the mounting pins 36 and 37 respectively to maintain the louvers 24 in their installed positions.

On the inner side, the inner legs 42 and 43 are in overlapping relationship with the side support walls 31 and 32 at their inner surfaces. The inner legs 42 and 43 have respectively formed therein, a plurality of longitudinally spaced slots 49 and 51 (see FIGS. 2, 4 and 5) which fit over the corresponding pivot pins 39 and 41 to capture those pivot pins within the slots. In this way, the inner legs 42 and 43 act as gang bars while the outer legs 44 and 46 act as retainer members.

Formed in the outer legs 44 and 46 are a plurality of notched openings 52. At corresponding positions on the outer sides of the side support walls 31 and 32 are a plurality of transversely extending flanges or barbs 53. Beveled surfaces 55 are provided on the barbs 53 to allow the retainer bar outer legs 44 and 46 to slide over the barbs 53 until the barbs become engaged with their respective notched openings 52. In this way, the retainer bars 26 and 27 are maintained in their installed positions.

Figure 3:
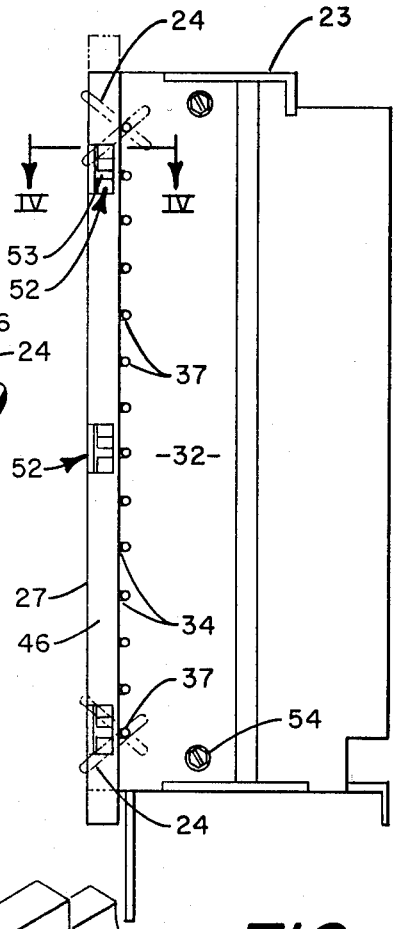
FIG. 3 is a side elevational view, thereof.

Shown in FIG. 3 is one side of the completed assembly with the side support walls 31 and 32 having the louvers 24 inserted into the slots 33 and 34, and the retainer bars 26 and 27 installed in their secured positions with the barbs 53 being engaged with their respective notched openings 52.

It will be apparent from the above descriptions of the various components, that the assembly of the louver structure is substantially easier and more simple than that of the conventional louver structure. The walls 28 29, 31 and 32 of the housing 23 are preferably formed of a plastic material with a conventional process such as injection molding. The walls are then secured together by conventional fasteners 54 or the like. Each of the louvers 24 are then installed into the housing 23 with their mounting pins 36 and 37 sliding into their corresponding slots 33 and 34. The louvers 24 are all placed at substantially the same angular positions such that their pivot pins 39 and 41 are equally spaced. The retainer bars 26 and 27 are then placed into position with their slots 49 and 51 sliding over the pivot pins 39 and 41, respectively. The retainer bars 26 and 27 are pushed downwardly until the support wall barbs 53 engage the notched openings 52. The louver assembly is then complete.

As will be seen in FIG. 3, the individual louvers 24 are pivotable through an arc of substantially 90°, and the retainer bars 26 and 27 act to maintain them at a common angle. A pivoting of the louvers can be accomplished by moving the retainer bars 26 or 27 up or down or, alternatively, one of the louvers can be used as a lever to pivot the entire array. As another alternative, it may be desirable to install a lever which would act to move the retainer bars 26 and 27 up or down, which would in turn act to pivot the louver array.

Figure 4:
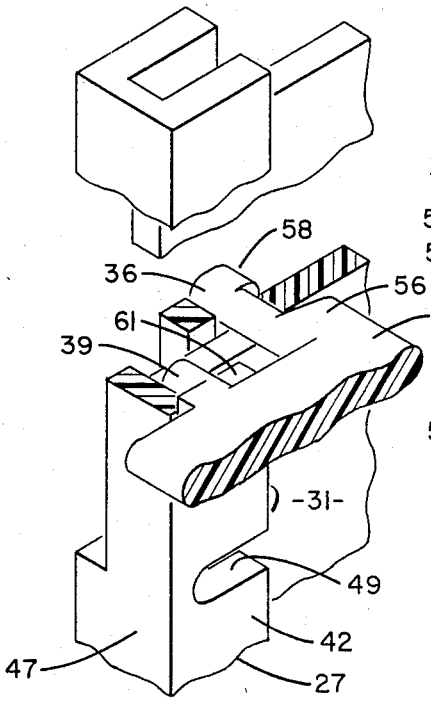
FIGS. 4 and 5 are partial perspective views of the louver and retainer elements with cross-sections taken in the plane 4—4 of FIG. 3.
Figure 5:
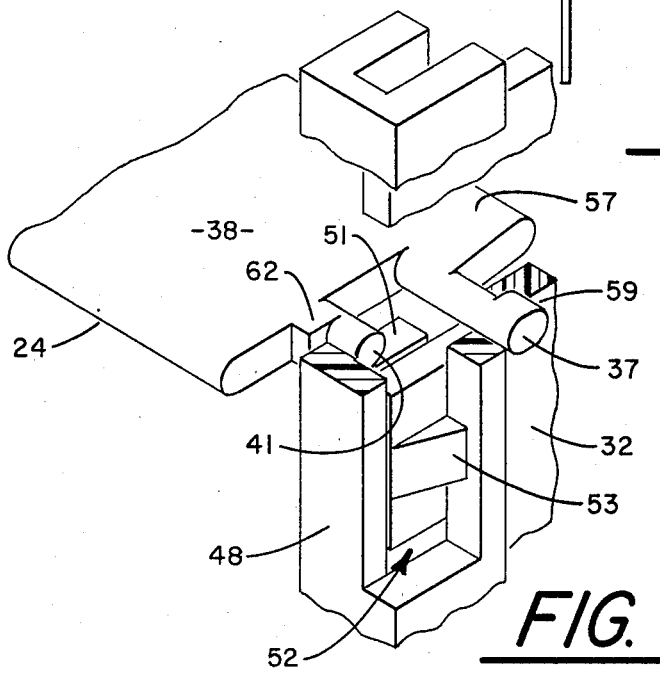

Referring now to FIGS. 4 and 5, it will be seen that, in order to provide for the proper positioning and relative movement of the various components, the louvers 24 have various other structural features proximate their ends. At the base of the mounting pins 36 and 37, there are extensions 56 and 57, respectively, to the blade portion 38. The purpose of these extensions is to extend the blade 38 to those areas behind the retainer bars 26 and 27 and to strengthen the mounting pins 36 and 37.

Also associated with the mounting pins 36 and 37, at the ends thereof, are lobes 58 and 59 which engage the outer surface of the side support walls 31 and 32, respectively, and thereby prevent the side support walls 31 and 32 from moving outwardly or, conversely, the mounting pins 36 and 37 for moving inwardly to thereby disengage from their respective slots 33 and 34.

At the base of the pivot pins 39 and 41 there are, integrally formed with the blade 38, a pair of pedestals 61 and 62 which act to engage the inner sides of the retainer bars 26 and 27 respectively to thereby maintain the proper transverse spacing at the side support walls 31 and 32 and allow for smooth pivotal movement of the louvers.

It will be understood that while the present invention has been described in terms of a preferred embodiment, it may take on any number of other forms while remaining within the scope and intent of the invention.

What is claimed is:

1. In an air conditioning apparatus of the type having an air discharge opening with a plurality of louvers adjustably disposed therein for directing the flow of discharge air, an improved louver mounting assembly comprising:

a pair of laterally spaced support members partially defining the air discharge opening, and having a plurality of longitudinally spaced rearwardly extending slots formed at the forward edges thereof;

a plurality of louvers with each having a mounting pin and a pivot pin on each end thereof, said mounting pins being sized and positioned so as to be slideably receivable and pivotably mounted in said support slots to suspend said louvers in mounted positions between said side support members, and said pivot pins being disposed forwardly of said mounting pins and outside of said support slots;

a pair of retainer bars disposed, in rearwardly abutting relationship with said mounting pins and including means for engaging said pivot pins to form a gang bar for coordinating the angled positions of the louvers; and means for securing said retainer bars to said support members to maintain said louvers in their mounted positions.

2. The louver mounting assembly as set forth in claim 1 wherein said pivot pin engaging means comprises a plurality of longitudinally spaced slots formed in the rear side of said retainer bars for slideably receiving said pivot pins therein.

3. The louver mounting assembly as set forth in claim 1 wherein said retainer bars securing means comprise a plurality of flanges on said support elements and corresponding notches formed in said retainer bars, said flanges being engagable with said notches to maintain said retainer bars in their installed rearward positions.

4. The louver mounting assembly as set forth in claim 1 wherein said retainer bars are U-shaped in cross section and are slideably disposed over the respective forward edges of said support members.

5. The louver assembly as set forth in claim 1 wherein said pivot pin engaging means comprises a plurality of spaced slots formed in the louver retaining means for slideably receiving said pivot pins therein.

6. A louver assembly for an air conditioning system of the type having an air discharge opening for the discharge of conditioned air into a room comprising:

a housing defining the air discharge opening and including a pair of spaced support members having a plurality of slots formed therein;

a plurality of louvers having mounting pins and pivot pins at their ends, said mounting pins being slideably receivable and pivotably mountable in said slots to suspend said louvers between said support members; and louver retaining means including a retainer bar attached to each of said support members and disposed in abutting relationship with one side of said mounting pins to maintain them in their installed positions within their respective slots, and also including means for engaging said pivot pins to thereby form a gang bar for coordinating the pivotal positions of the louvers.

7. An improved method of assembling a louvered air discharge mechanism of the type having a plurality of louvers pivotally supported at their mounting pins by a pair of spaced support elements comprising the steps of:

forming pivot pins at the ends of said plurality of louvers, said pivot pins being in generally parallel relationship with said mounting pins;

forming a plurality of longitudinally spaced, rearwardly extending, slots in the forward edges of the support elements;

forming a plurality of slots on the rear edge of each of a pair of retainer bars, said retainer bar slots having generally the same spacing as said plurality of support element slots;

installing the plurality of louvers into their desired positions by rearwardly sliding their mounting pins into corresponding support element slots;

while sliding said retainer bar slots over said pivot pins, concurrently placing, proximate the forward edge of each support element, the retainer bar with its rear edge thereof extending longitudinally across the span of the plurality of louver mounting pins to form a barrier for preventing the louver mounting pins from moving forwardly out of said support element slots; and securing the retainer bars to the support elements.

8. The method of assembly as set forth in claim 7 wherein said retainer bars have notches formed therein and said support elements have beveled flanges formed thereon in corresponding locations, and further wherein the step of securing the retainer bars is accomplished by pushing the retainer bars toward the support elements until said beveled flanges become engaged in their corresponding notches.

* * * * *